United States Patent [19]

Shibaike et al.

[11] Patent Number: 5,077,565

[45] Date of Patent: Dec. 31, 1991

[54] INK RECORDING APPARATUS WITH SLIDER TO CONTROL JETTED INK AMOUNT

[75] Inventors: Narito Shibaike, Hirakata; Soichiro Mima, Nishinomiya, both of Japan

[73] Assignee: Matsushita Electric Industrial Co., Ltd., Osaka, Japan

[21] Appl. No.: 610,047

[22] Filed: Nov. 6, 1990

[30] Foreign Application Priority Data

Nov. 9, 1989 [JP] Japan ..... 1-292898

[51] Int. Cl.[5] ..... B41J 2/07

[52] U.S. Cl. ..... 346/140 R

[58] Field of Search ..... 346/140 R

[56] References Cited

U.S. PATENT DOCUMENTS 4,199,767 4/1980 Cambell et al. ..... 346/75

FOREIGN PATENT DOCUMENTS 0133338 10/1979 Japan ..... 346/140 R
0079665 4/1986 Japan ..... 346/140 R
62-30050 2/1987 Japan .
62-101445 5/1987 Japan .

*Primary Examiner*—Benjamin R. Fuller
*Assistant Examiner*—Alrick Bobb
*Attorney, Agent, or Firm*—Wenderoth, Lind & Ponack

[57] ABSTRACT

An ink recording apparatus used with printers or the like and manufactured by applying semiconductor device manufacturing techniques. One wall of an ink chamber is formed of a single-crystal substrate and an ink jet port is formed by etching on the single-crystal substrate. A slider and electrodes composed of polycrystalline-silicon film are formed on the single-crystal substrate by film forming in the LPCVD method and patterning through plasma etching. The slider has a plurality of ink passing holes which have respectively different diameter, being driven by electrostatic attracting force produced between voltage-applied electrodes and the slider. The electrodes are formed at positions corresonding to those where the each ink passing hole is aligned with the ink jet port.

3 Claims, 14 Drawing Sheets

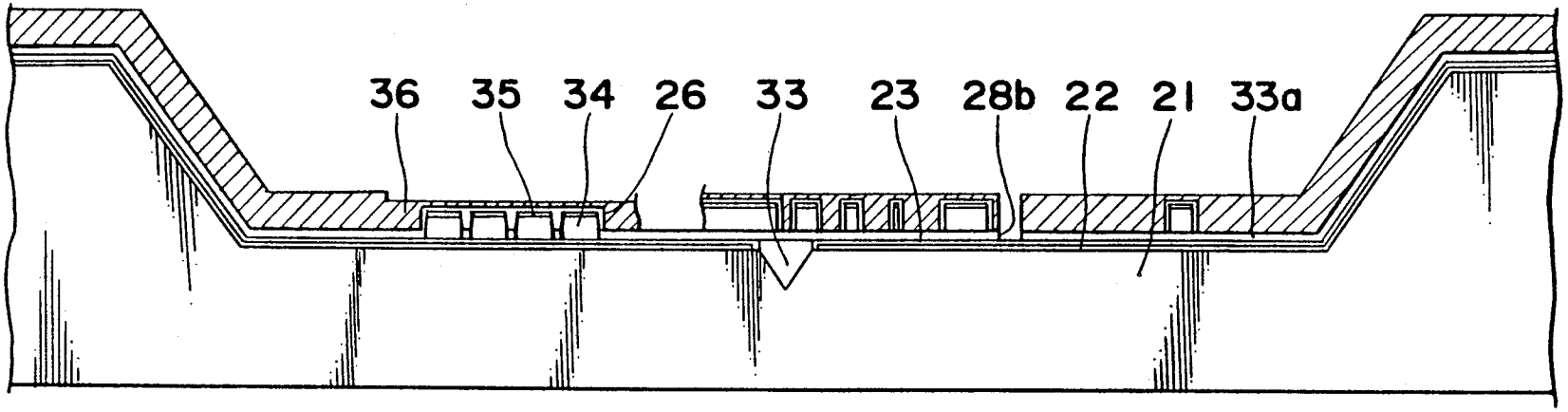
Fig. 7k
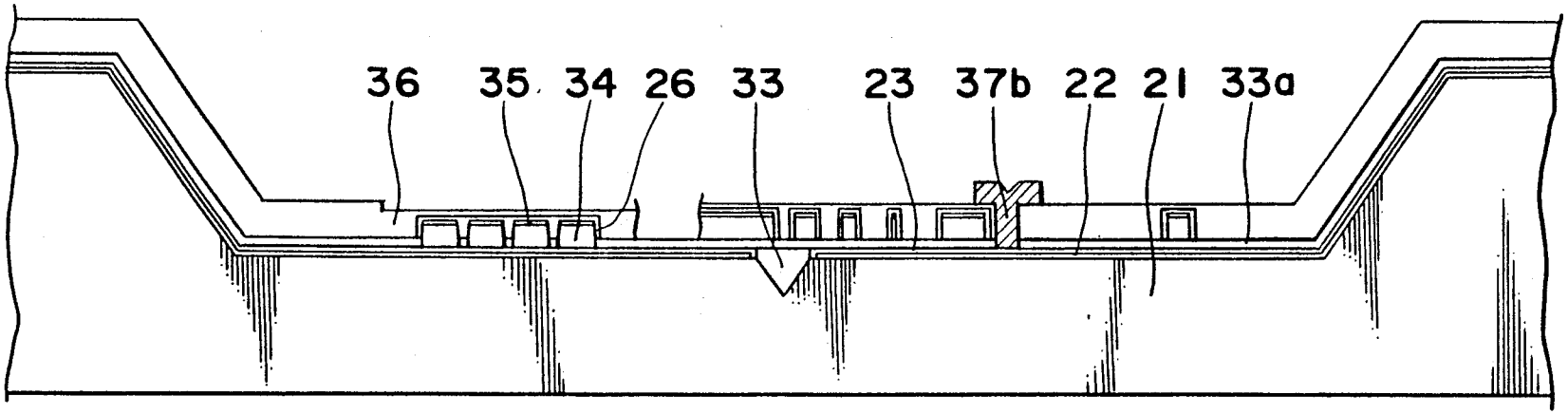
Fig. 7ℓ

INK RECORDING APPARATUS WITH SLIDER TO CONTROL JETTED INK AMOUNT

BACKGROUND OF THE INVENTION

1. Field of the invention

The present invention relates to an ink recording apparatus for use in printers or the like. It is to be noted that the word 'recording' herein used refers to the fact that any desired patterns of characters, symbols, or the like are written down onto a printed material such as paper with ink jetted out by an apparatus of the present invention.

2. Description of the related art

A conventional ink recording apparatus is shown in the Japanese magazine "Nikkei Mechanical", issued on May 29, 1989, pp. 90 to 91, the apparatus exemplifying such ink recording apparatus that are currently used in printers featuring compactness suitable for office or personal use thereof.

FIG. 11 shows a construction of such a conventional ink recording apparatus. In the figure, a slit plate 1 is provided with a plurality of slits 2 having a width of 50 μm and a length of 8 mm in place of nozzles. The slit plate 1 has also a plurality of auxiliary holes 3 equal in number to a plurality of heating elements 5 formed on a base plate 4, with an ink reservoir 6 as well provided at the slit plate. On the base plate 4 there are formed a plurality of electrodes 7 in correspondence to the heating elements 5 and moreover a plurality of fluid resistance elements 8 shaped into a long, narrow protrusion. Besides, between the slit plate 1 and the base plate 4 there is disposed a spacer 9, which in conjunction with the slit plate 1 and base plate 4 defines a portion serving as an ink chamber 11 illustrated in FIGS. 12*a* to 12*d*. Under the base plate 4 there is provided an ink tank 10, whereon all the units are piled up to make up a head. The heating elements 5 and formed by piling up a glass layer, resistors, electrodes, and a protective coat on the base plate 4, as in a common thermal head.

A conventional ink recording apparatus having a construction as described above will jet ink droplets while overcomes steps as shown in FIGS. 12*a* to 12*d*. Each step is detailed below:

(a) First, when pulse voltage is applied to the heating elements 5 on the base plate 4 to heat the ink contained in the ink chamber 11, the ink in the vicinity of the heating elements 5 vaporizes to make a large number of small bubbles 12;

(b) Second, the small bubbles 12 merge together and grow into a larger bubble 13 that overcome the surface tension, causing ink swells to be produced at the slits 2;

(c) Third, when the heating elements 5, on completion of heating, are cooled down to stop the bubble 13 from being produced, the swelling of ink is intercepted to produce ink droplets 14; and (d) Finally, the ink droplets 14 are jetted out through the slits 2 by the power of growing bubble 13.

If a number of heating elements 5 share the slits 2 and the ink chamber 11 with one another as in the above conventional apparatus, there arises a problem that the ink droplets 14 derived from adjoining heating elements 5 may interfere with each other. In the conventional apparatus, however, the fluid resistance elements 8 provided between adjoining heating elements 5, 5, as shown in FIG. 11, will serve to prevent pressure waves from being horizontally propagated while the bubbles are being produced, thereby allowing the ink droplets 14 to be formed and jetted out without being adversely affected by such pressure waves. Furthermore, the auxiliary holes 3 provided to the slit plate 1 will absorb the pressure waves, so that pressure waves may be prevented also from being reflected.

In the conventional apparatus arranged as described above, since the apparatus can not vary the size of ink droplets, it is forced to perform pseudo area gradation recording by signal a process instead of area gradation recording. The result is that the roughness in the picture quality is noticeable due to dither and the like. Accordingly, the conventional apparatus produces inferior picture quality compared to an apparatus employing another recording system, e.g. a heat sublimation system type printer which uses a sublimation type dye. Although, it is possible to inject ink droplets at a point, one over the other, it takes a long time to record one dot when a dynamic range is set to be wide. As a result, the high speed recording performance of the ink jet system is poor.

SUMMARY OF THE INVENTION

The present invention has been accomplished to effectively solve above-mentioned technical problems and, accordingly, an essential object of the present invention is to provide an ink recording apparatus which can perform high speed recording and also area gradation recording by varying the ink droplet size and shape.

In accomplishing these and other objects, according to one preferred embodiment of the present invention, there are provided an ink chamber for being filled with ink, an ink jet port disposed in the ink chamber, a slider disposed in the vicinity of the ink jet port and controlling a jetted ink amount, and means for driving the slider, the slider driving means having electrodes provided in correspondence to each of the predetermined positions, a power supply for applying voltage to the electrodes, and a control circuit, whereby the slider is driven by virtue of electrostatic attracting force acting between the surfaces of the electrodes and the surface of the slider.

With the above-mentioned arrangement of the embodiment of the ink recording apparatus according to the invention, the slider disposed in the vicinity of the ink jet port permits forming ink droplets of different size and shape so that area gradation recording as well as high speed recording is possible.

BRIEF DESCRIPTION OF THE DRAWINGS

These and other objects and features of the present invention will become apparent from the following description taken in conjunction with the accompanying drawings, in which.

DETAILED DESCRIPTION OF THE INVENTION

Figure 1:
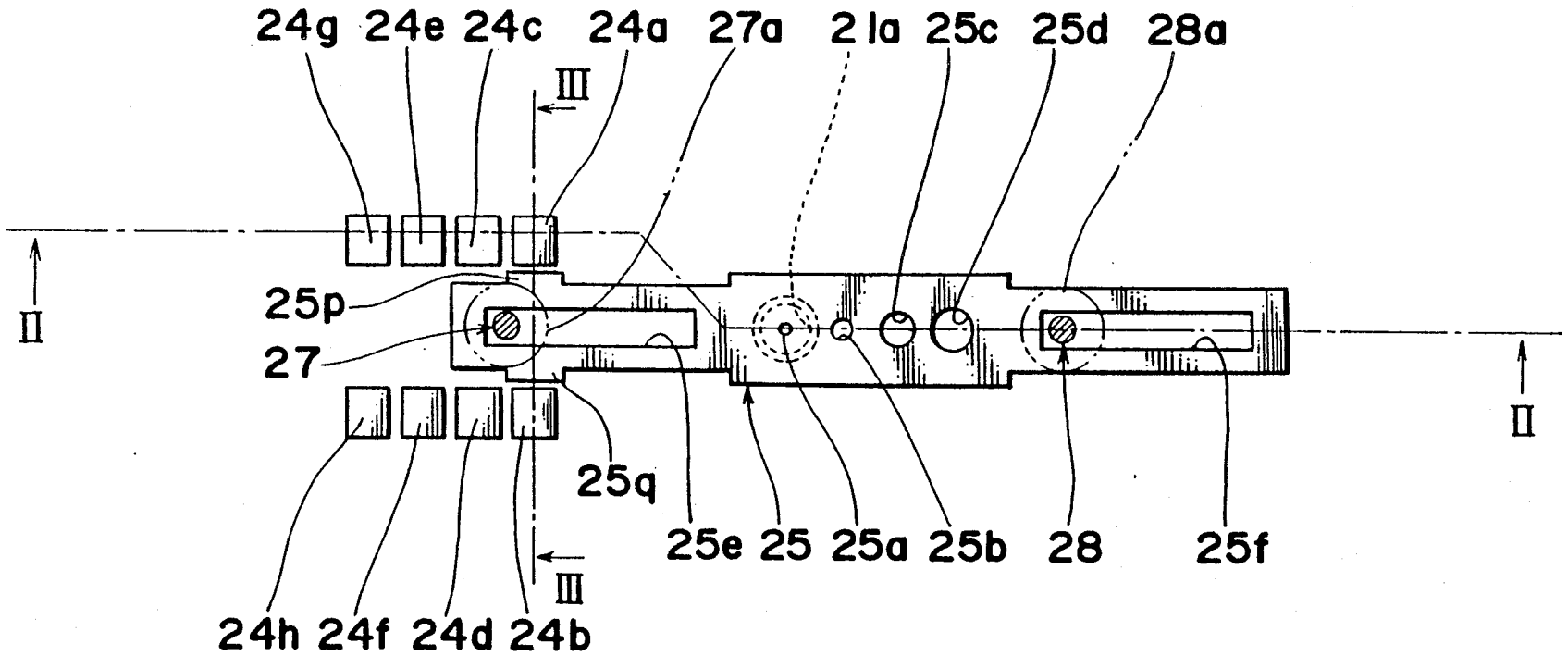
FIG. 1 is a plan view showing the construction of an ink recording apparatus of a first embodiment according to the present invention.

Before the description of the present invention proceeds, it is to be noted that like parts are designated by like reference numerals throughout the accompanying drawings.

Figure 2:
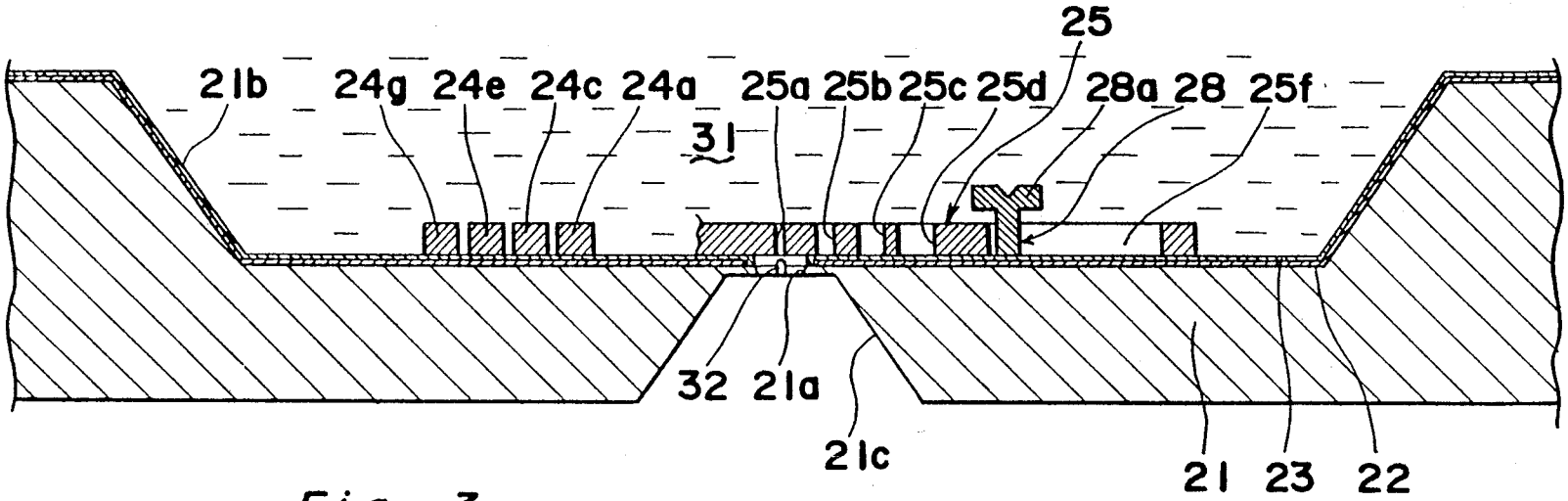
FIG. 2 is a sectional view taken along line II—II of FIG. 1.
Figure 3:
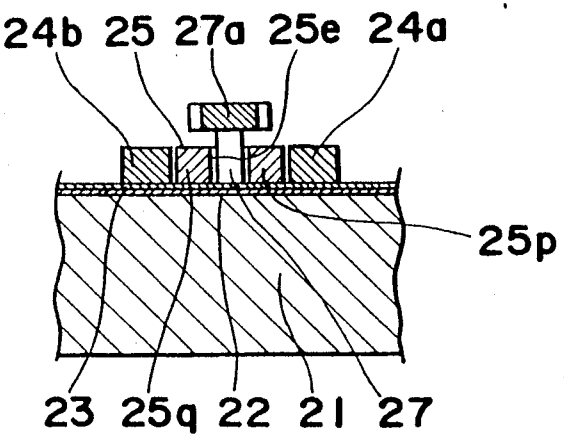
FIG. 3 is a sectional view taken along line III—III of FIG. 1.
Figure 11:
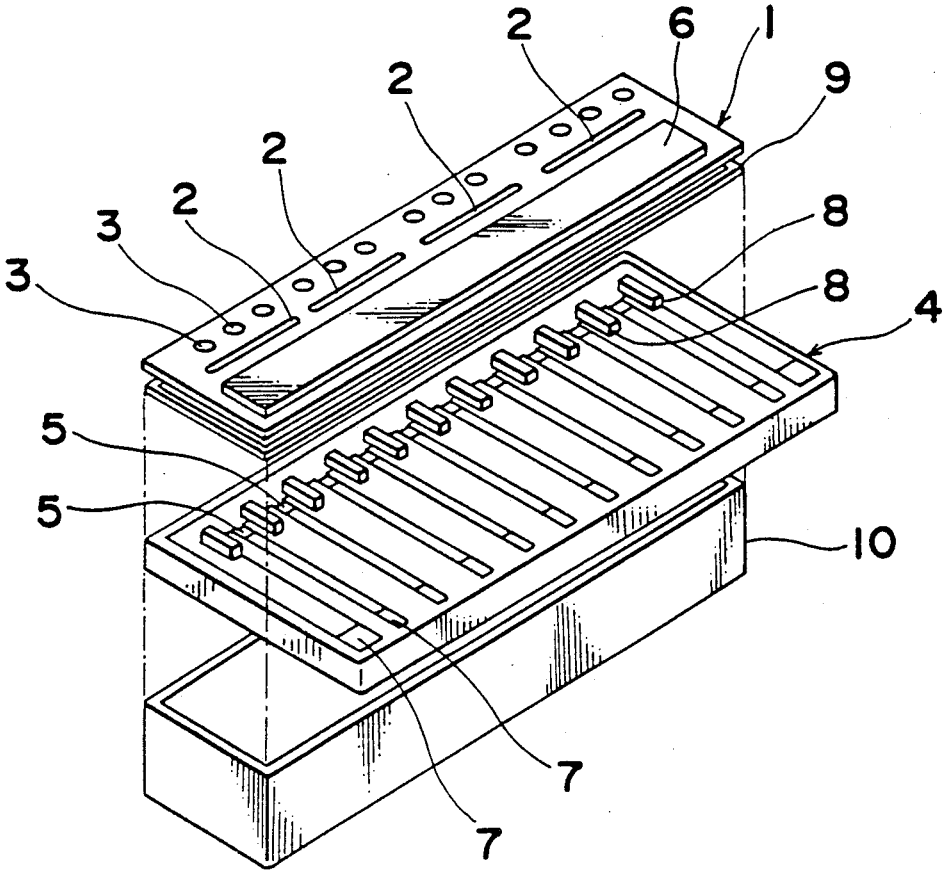
Fig. 11 PRIOR ART
FIG. 11 is a perspective view showing the construction of an ink recording apparatus according to the prior art.
Figure 12A:
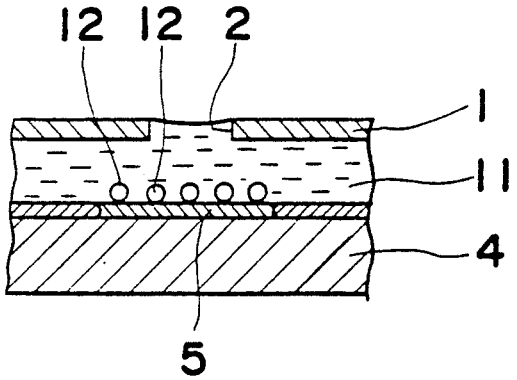
Fig. 12a PRIOR ART
FIGS. 12*a* to 12*d* are views illustrating the operation of the apparatus of FIG. 11.
Figure 12B:
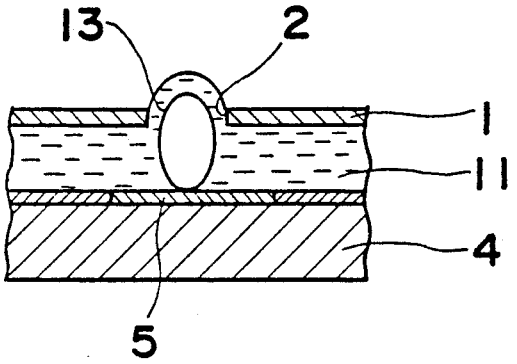
Fig. 12b PRIOR ART
Figure 12C:
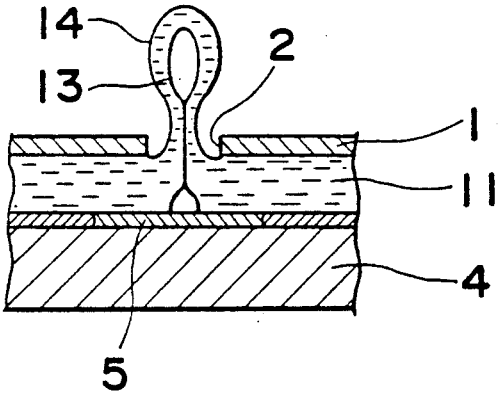
Fig. 12c PRIOR ART
Figure 12D:
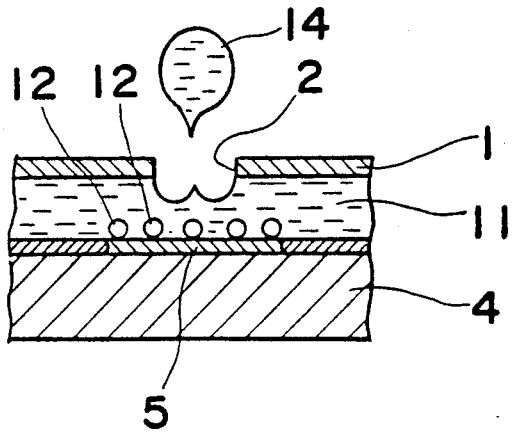
Fig. 12d PRIOR ART

Referring first to FIGS. 1 to 3, a single-crystal silicon substrate 21 has an ink jet port 21*a* and an ink chamber 21*b* provided in the center thereof and a recess 21*c* provided on its back side. The ink chamber 21*b* is connected with the recess 21*c* through an oxide film 22, a nitride film 23 and the ink jet port 21*a*. Electrodes 24*a* to 24*h* formed of polycrystalline-silicon, the wiring of which is omitted in the figures, each have on their surfaces a nitride film 23 formed as an insulating layer (not shown). A slider 25 formed of polycrystalline-silicon has ink passing holes 25*a* to 25*d* provided in its center and guide slots 25*e*, 25*f* provided on opposite sides thereof. Each of the ink passing holes 25*a* to 25*f* has a different diameter which is smaller than that of the ink jet port 21*a*. On the surfaces of the slider 25 except the underside thereof there are formed nitride films (not shown) as lubricating layers. Guide pins 27, 28 are formed also of polycrystalline-silicon. The guide pins 27, 28 have flanged portions 27*a*, 28*a* illustrated by single dotted chain lines in FIG. 1, so that the slider 25 does not slip off. On the other hand, the ink chamber 21*b* is charged with ink 31 composed of insulating material. The ink 31 is subject to working pressures corresponding to recording signals through ordinary means such as a pressure device comprising a piezoelectric element or a heating element as shown in FIG. 11, which means is not shown.

The component parts shown in FIGS. 1 to 3, as detailed later, are integrally manufactured onto the substrate 21 using semiconductor device manufacturing processes including lithography and etching. The result is that the component parts are substantially compact in size, light in weight, and of high precision, and are comparable to semiconductor products.

Figure 4:
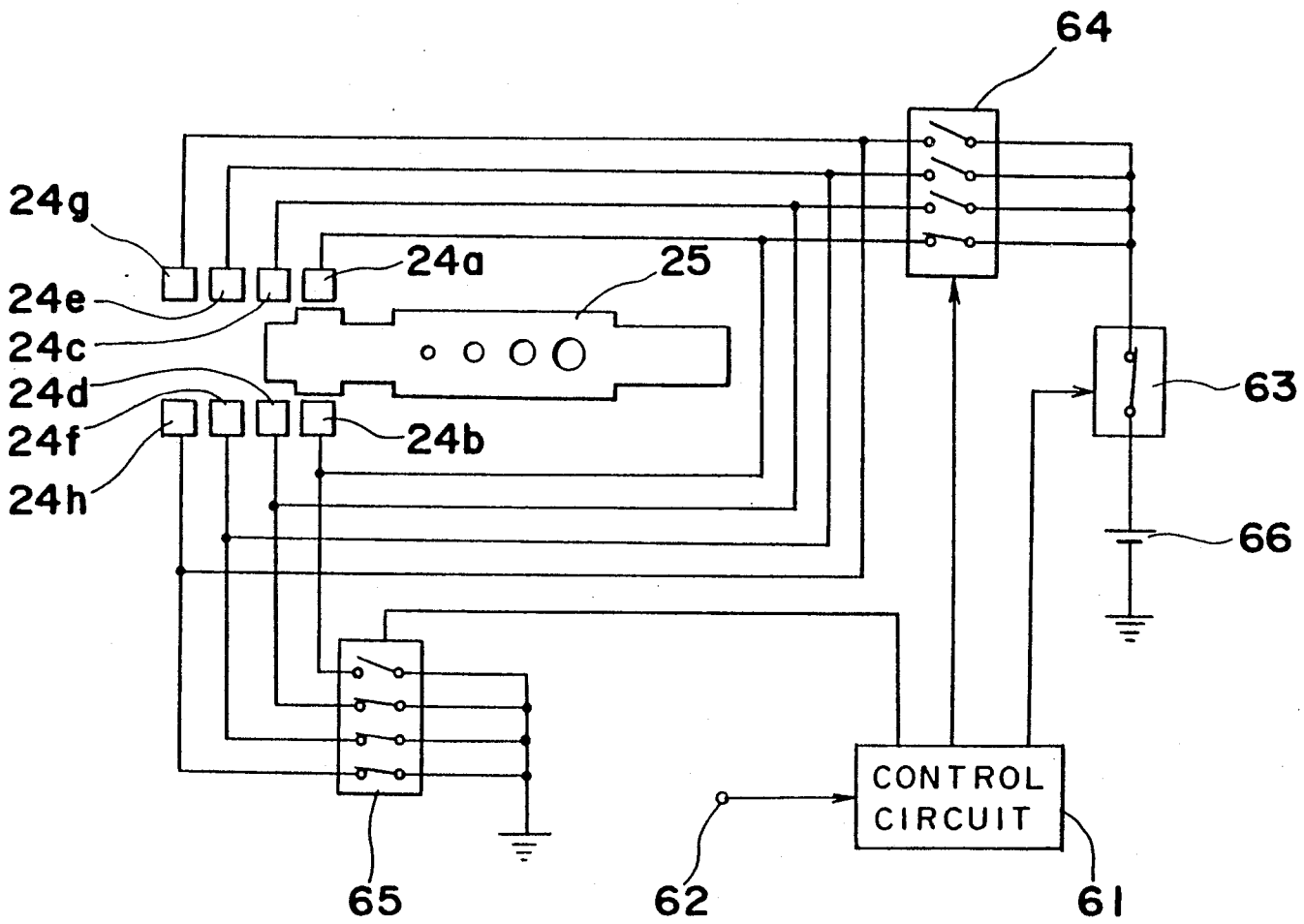
FIG. 4 is a block diagram showing a driving circuit of the ink recording apparatus of FIG. 1.

FIG. 4 is a block diagram showing a driving circuit for driving the ink recording apparatus. In the figure, a control circuit 61 receives a recording signal from the apparatus main body (not shown) via an input terminal 62, subsequently deciding the status of the signal to control switches 63 to 65. The switch 63 serves to turn on and off a power supply 66, while the switches 64 and 65 serve to control four pairs of connected electrodes 24*a*, 24*b*, or 24*c*, 24*d* or 24*e*, 24*f* or 24*g*, 24*h*, respectively, so as to render the one pair of electrodes oppositely phased to the rest of pairs. For example, while a voltage is applied to the one pair of the electrodes 24*a*, 24*b*, the rest of electrodes 24*c*, 24*d*, 24*e*, 24*f*, 24*g*, and 24*h* are grounded.

Now the ink recording apparatus arranged as stated above will be explained with respect to its operation. The state thereof shown in FIGS. 1 to 3 is such that the control circuit 61 judges the apparatus to be in recording operation according to an input signal delivered from the apparatus main body via the input terminal 62, turning on the switch 63 and activating the switches 64, 65, with the result that a voltage of several times 10 V or so is applied to the one pair of the electrodes 24*a*, 24*b*. In this state, the slider 25 is stably positioned as shown in the figures with its ends 25*p*, 25*q* sucked up by virtue of electrostatic attracting force acting between the ends and the surfaces of the electrodes 24*a*, 24*b*, where the ink passing hole 25*a* of the slider 25 is aligned with the ink jet port 21*a* provided to the substrate 21. Then, due to the pressure within the ink chamber 21*b*, the ink 31 charged in the ink chamber 21*b* passes through the ink jet port 21*a* and ink passing hole 25*a*, thus making ink droplets 32 to be jetted out.

At this point of the state of the apparatus, setting recording paper (not shown) at the outside of the substrate 21 allows the ink droplets 32 to record any patterns of characters, symbols, and the like. When the ink droplets 32 are jetted out, the ink 31 in the ink chamber 21*b* applies pressure on the slider 25. The slider 25 is always supported by substrate 21 on the nitride film 23 which is formed as an insulating and lubricating layer. Therefore, the slider 25 is not distorted by the pressure of the ink 31, and the ink does not leak out. Moreover, the substrate 21 serves to protect an operator's hands or fingers or prevent other foreign matters from touching the slider 25 from outside, thereby preventing the internal structure including the slider 25 from being damaged resulting in high reliability thereof.

Figure 5:
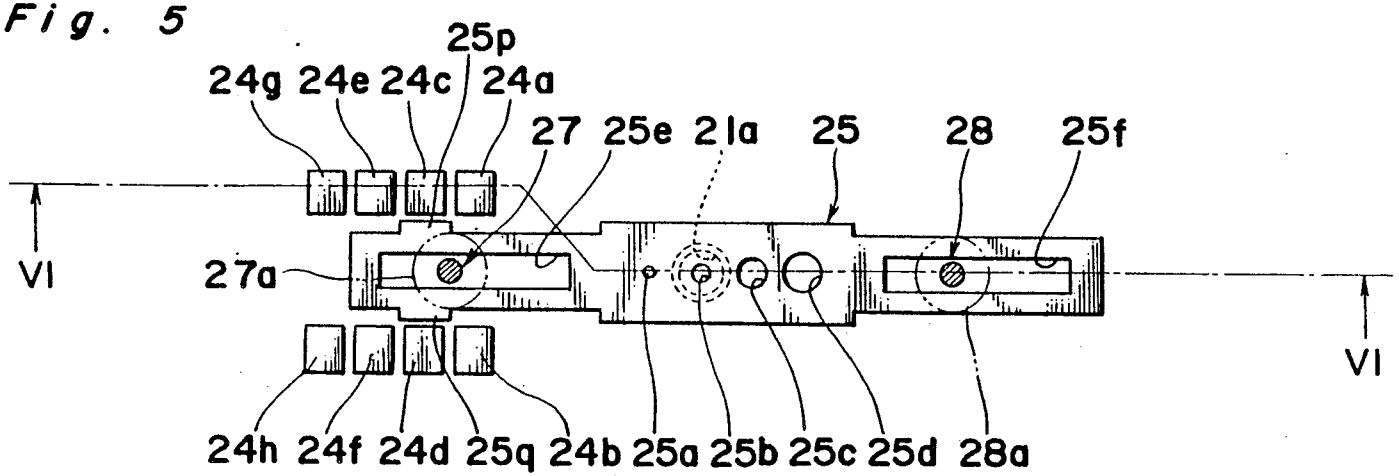
FIG. 5 is a view illustrating the operation of the ink recording apparatus of FIG. 1.
Figure 6:
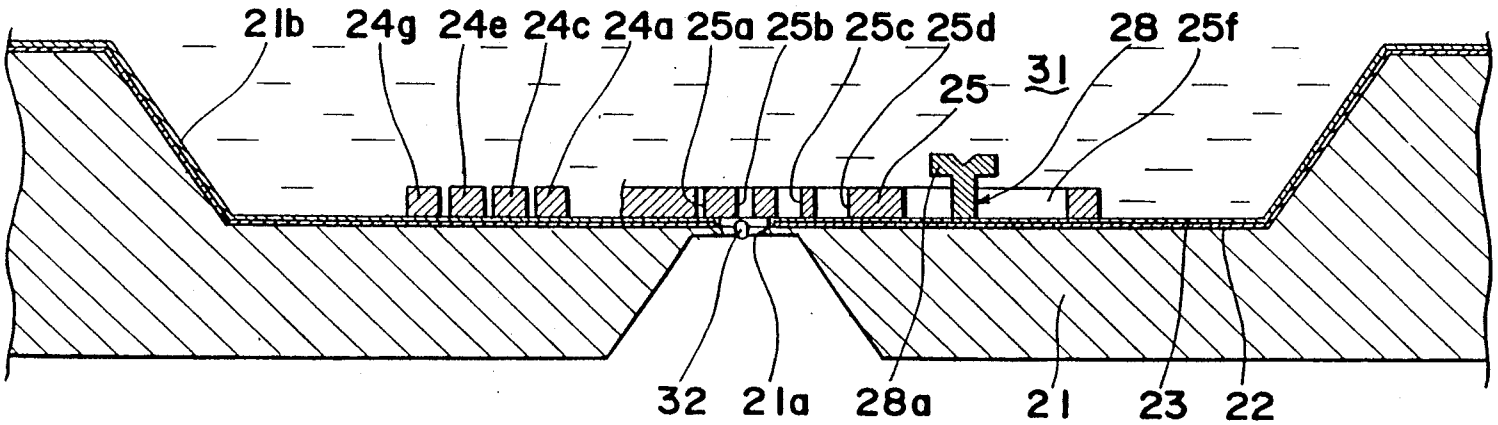
FIG. 6 is a sectional view taken along line VI—VI of FIG. 5.

Next, with reference to FIGS. 5 and 6, the ink recording apparatus will be described in its states in which the slider 25 has moved away from the position shown in FIGS. 1 to 4. In this case, the control circuit 61 judges that the recording condition in respect to the ink droplet has been changed according to an input signal delivered from the apparatus main body via the input terminal 62, changing the condition of the switches 64, 65, with a result such that a voltage is applied to another pair of the electrodes 24*c*, 24*d*. In this case, as shown in FIG. 5, the slider 25 is stably positioned at rest having moved from the position shown in FIG. 1 with its ends 25*p*, 25*q* sucked up by virtue of electrostatic attracting force acting between the ends and the surfaces of the electrodes 24*c*, 24*d*, where the ink jet port 21*a* is aligned with the ink passing hole 25*b*, thus ink droplets which have a diameter specified by the diameter of the ink passing hole 25*b* are jetted through the ink jet port 21*a*. The ink droplets jetted through the ink passing hole 25*a*, because the hole 25*b* is larger diameter than the hole 25*a*.

The pressure in the ink chamber 21*b* may change according to the ink passing hole size. Specifically, when an ink passing hole to be aligned with the ink jet port 21*a* is changed from the hole 25*a* to the larger hole 25*b*, the ink pressure may be increased depending on the difference of the hole size. Thus, it takes a constant time to record a dot on recording paper despite the dot size.

When a voltage is applied to the other pair of the electrodes 24*e*, 24*f*, or another pair of the electrodes 24*g*, 24*h*, the slider 25 moves so that the ink passing hole 25*c* or 25*d* is aligned with the ink jet port 21*a*. Therefore the ink recording apparatus according to the present invention can jet various size ink droplets. Further, the apparatus is capable of finely variable gradation by means of changing the diameter of the ink passing holes, pressure in the ink chamber and pressuring time. Accordingly, ensuring the dynamic range depending on the range of diameters of the ink passing holes and also controlling the pressure condition, the ink recording apparatus can perform area gradation recording and the gradient is enough to make the apparatus useful.

As described heretofore, according to the present invention, it is possible to provide an ink recording apparatus which can perform area gradation recording and high speed recording because the area and the shape of the aperture through which the ink droplets are jetted are variable by moving the slider 25 such that one of the ink passing holes 25*a* to 25*d* is aligned with the ink jet port 21*a*.

In the above described embodiment, the slider 25 has four sizes of ink passing holds 25*a* to 25*d*. However, the quantity of the hole sizes may by increased as necessary.

Next, with reference to FIGS. 7*a* to 7*n*, the manufacturing method of the ink recording apparatus of the above-mentioned embodiments will be described, wherein, since the method utilizes the one generally used in semiconductor device manufacturing techniques, the description of individual processes will be simplified by omitting the details thereof which are common knowledge.

Figure 7A:
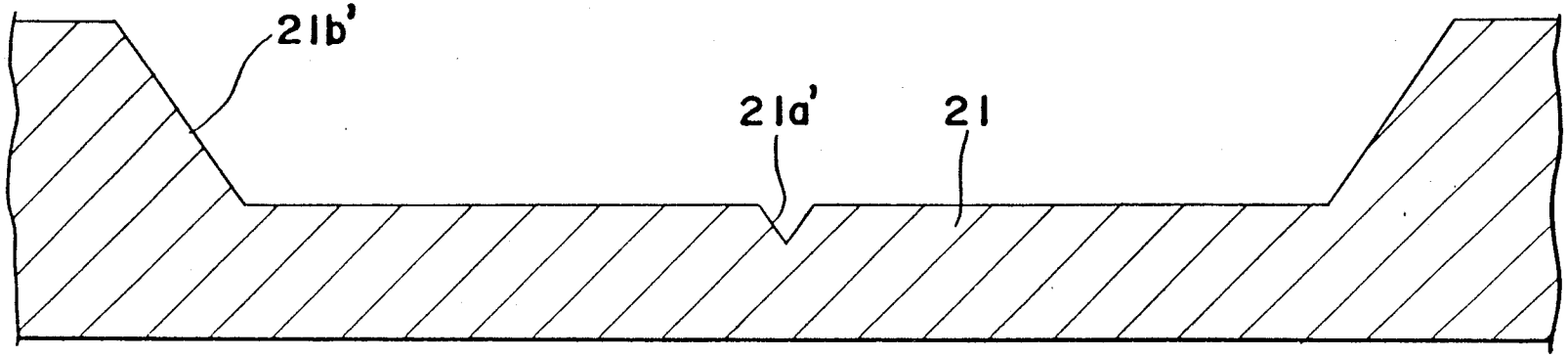
FIGS. 7*a* to 7*n* are views illustrating the manufacture processes of the ink recording apparatus of FIG. 1.

(a) A concave portion 21*b*' as illustrated in FIG. 7*a* is formed on the surface of the single-crystal silicon substrate 21 by anisotropic etching. Subsequently, another concave portion 21*a*' as illustrated is also formed in the previous concave portion 21*b*' by anisotropic etching. As the etching solution, an aqueous solution of potassium hydroxide (KOH) is used. Photoresist is removed by photoresist stripping using oxygen plasma. The removing of photo-resist is carried out likewise in the following processes.

Figure 7B:
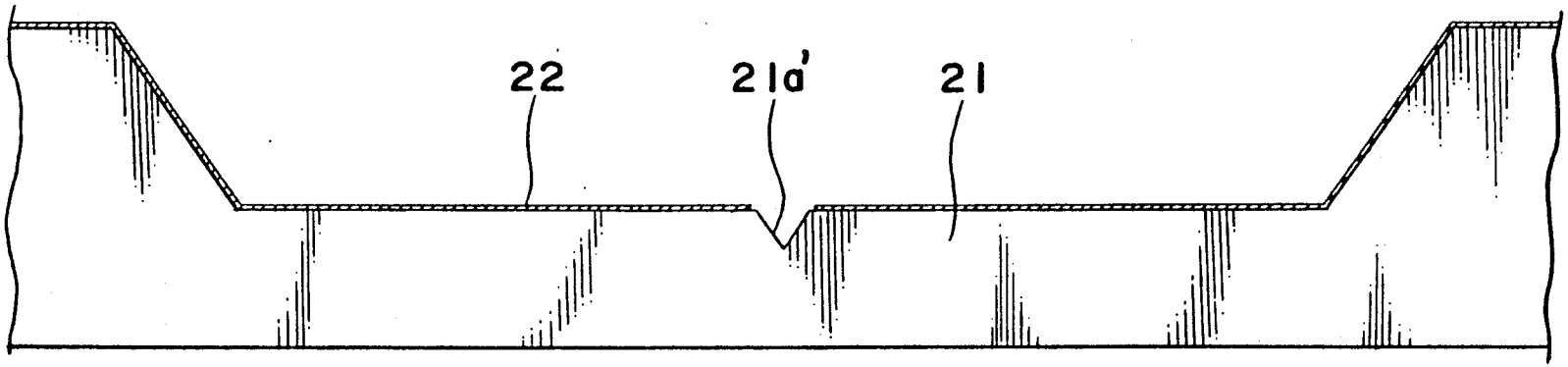
Figure 7C:
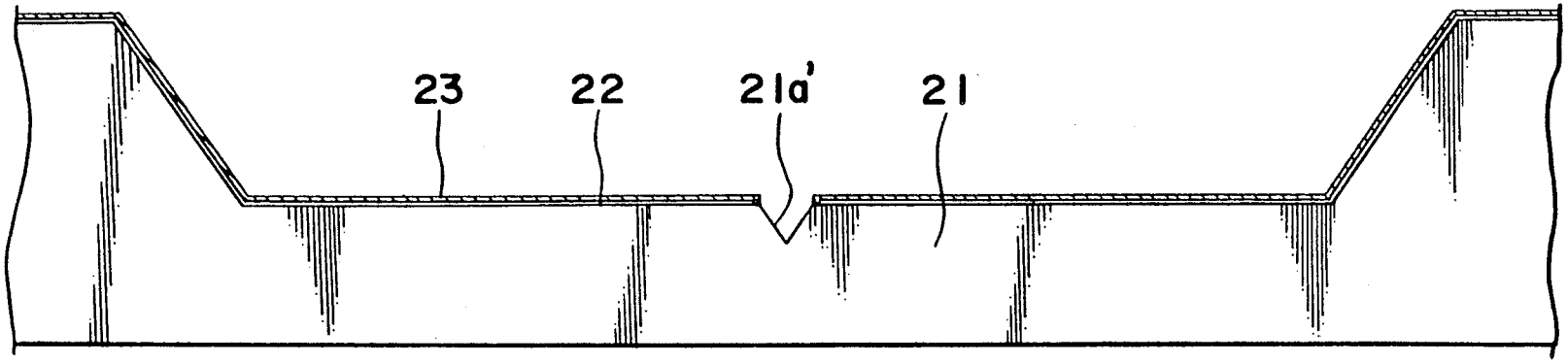

(b) The oxide film 22 ($SiO_2$) is made to grow on the concave portion 21*b*' and the substrate 21, where the oxide film 22 is grown by depositing a PSG (Phosphor Silicate Glass) layer 33 of a weight ratio of 8% by the method of LPCVD (Low Pressure Chemical Vapor Deposition) at a temperature of approximately 450° C., and the film 22 is etched using a buffered hydrofluoric acid, as shown in FIG. 7*b*.

(c) The nitride film 23 ($Si_3N_4$) is deposited on the oxide film 22, subjected to patterning by RIE (reactive-ion-etching). The nitride film 23 in combination with the oxide film 22 makes up an insulating layer, the dielectric breakdown voltage of which is more than 500 V. The nitride film 23 also serves to protect the oxide film 22 dissolved with the buffered hydrofluoric acid.

Figure 7D:
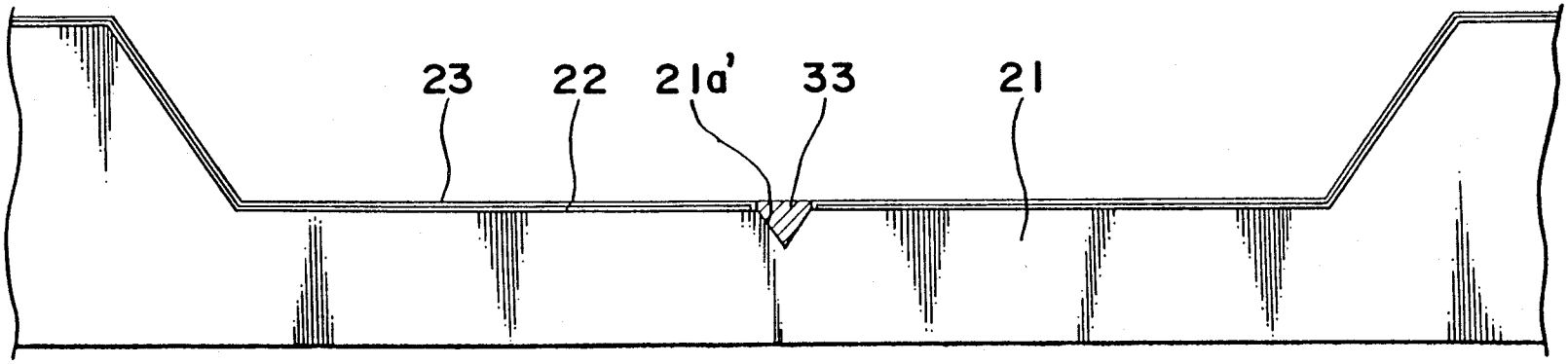

(d) A PSG layer 33 of a weight ratio of 8% is deposited by the LPCVD method at approximately 450° C. The concave portion 21*a*', is formed by dissolution of the oxide and plasma etching, as shown in FIG. 7*d*.

Figure 7E:
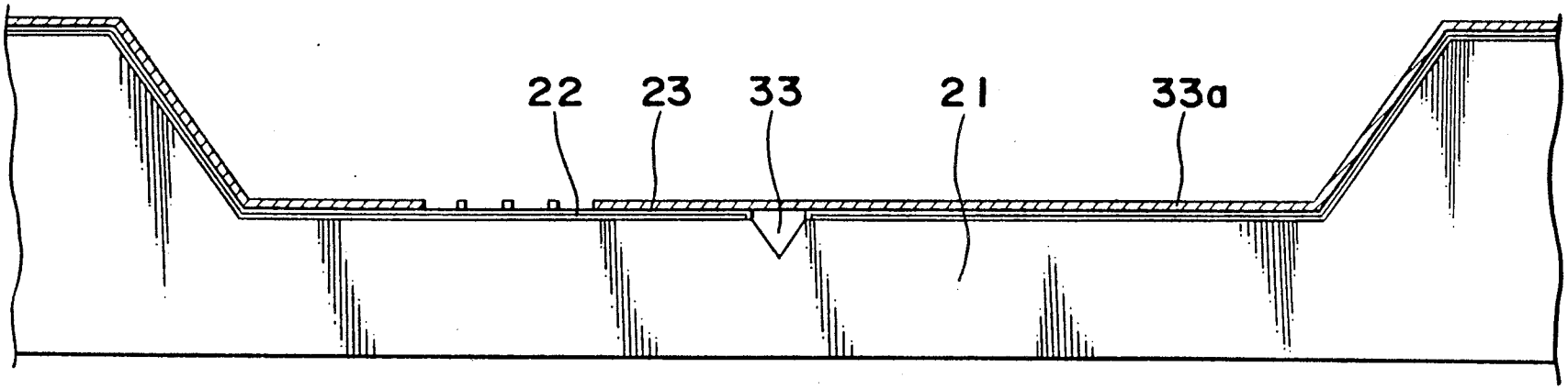
Figure 7F:
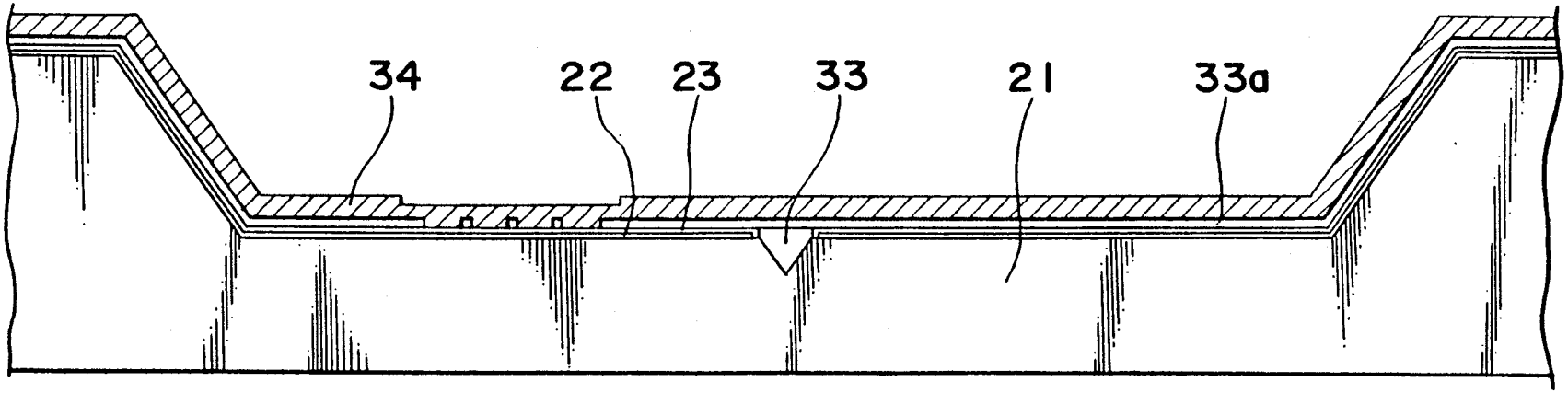

(e) As shown in FIG. 7*e*, a PSG layer 33*a* is deposited and followed by etching.

(f) A polycrystalline-silicon layer 34 is entirely deposited at approximately 610° to 630° C. by the LPCVD method and shaped as shown in the figures by plasma etching. The polycrystalline-silicon layer 34 forms the electrodes 24*a* to 24*h* and the slider 25. Then, annealing is performed to remove the residual stress. In addition, the polycrystalline-silicon layer 34 may be imparted with electrical conductivity by diffusing phosphorus thereinto as required.

(g) An oxide film 35 is made to grow on the polycrystalline-silicon layer 34, where for the oxide film 35 a PSG layer may be deposited. The oxide film 35 will serve as a protection film for the RIE later formed.

Figure 7G:
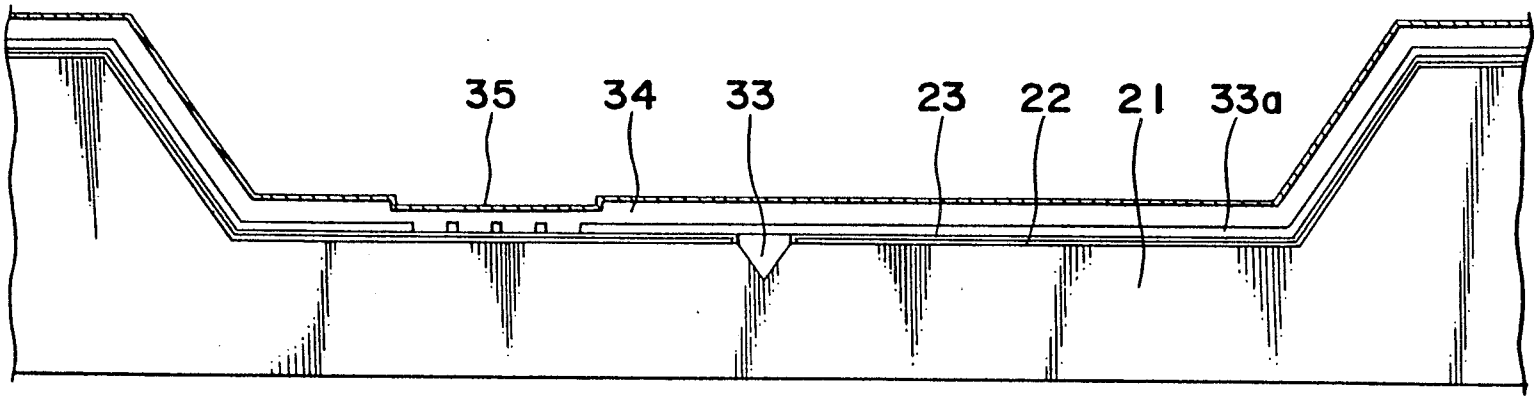

(h) The polycrystalline-silicon layer 34 and the oxide film 35 are subjected to patterning by plasma etching as shown in FIG. 7*g*, thereby being shaped into the electrodes 24*a* to 24*h* and the slider 25 which are shown in FIG. 1. In this process, end points are detected with 30% overetching, and annealing is performed to remove the residual stress.

Figure 7H:
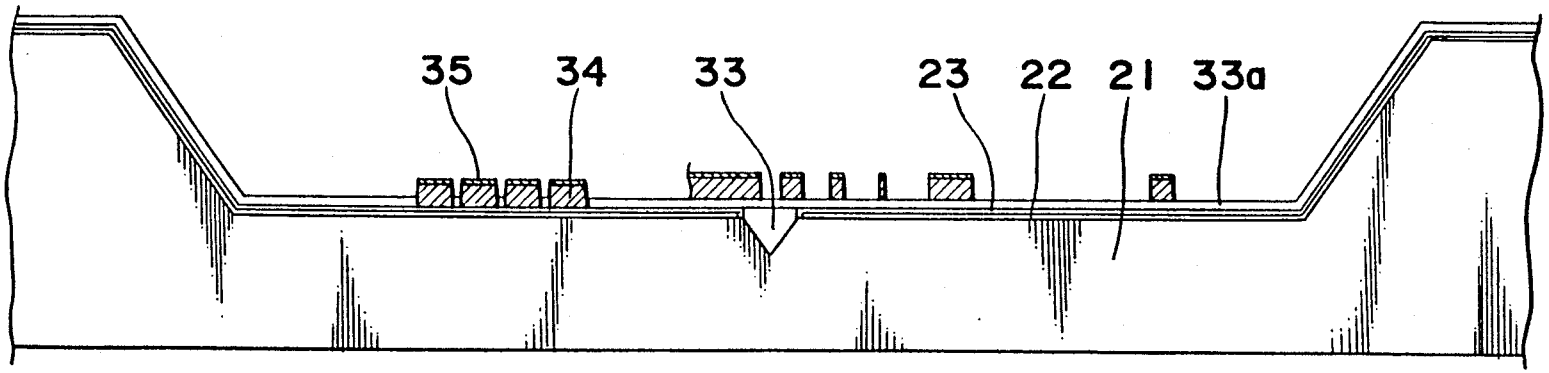
Figure 7I:
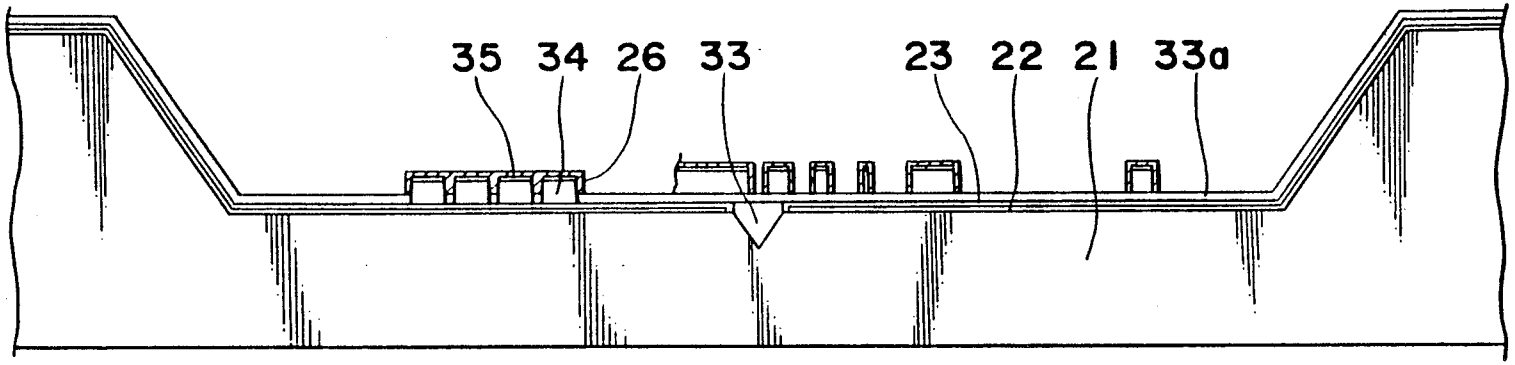
Figure 7J:
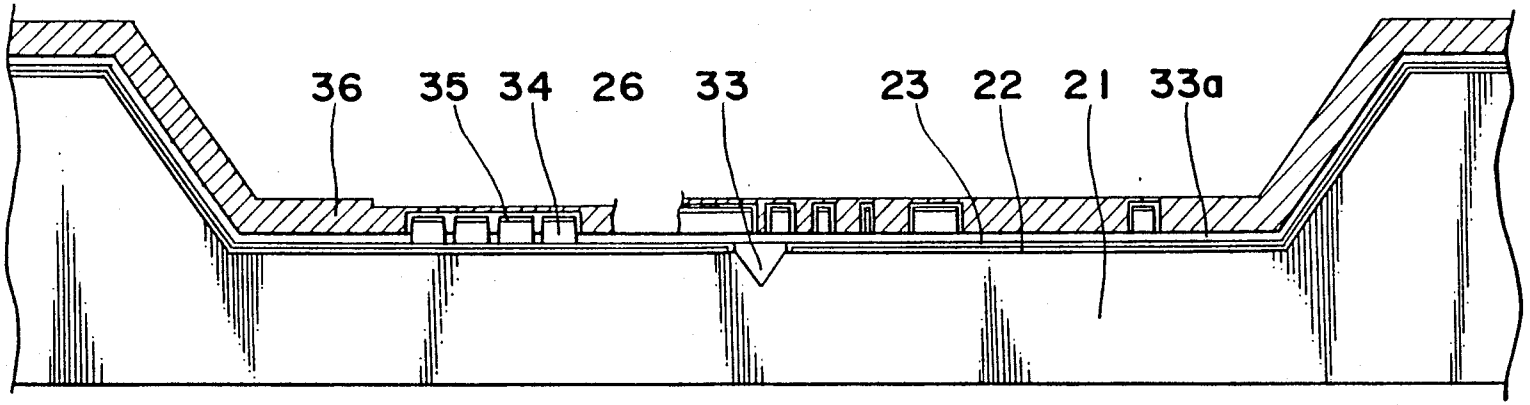
Figure 7M:
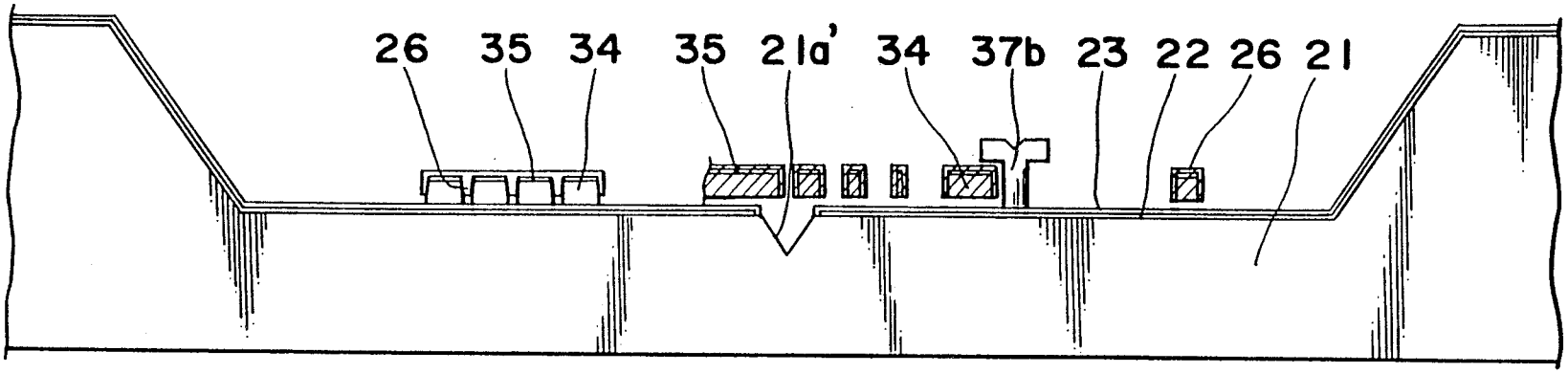

(i) A nitride ($Si_3N_4$) film 26 is deposited as shown in FIG. 7*h*, where patterning is performed by the RIE. The nitride film 26 finally forms the above-mentioned nitride film (not shown), serving as a lubricating layer for reducing the friction between the slider 25 and relevant portions and compensating the brittleness of materials and also as an insulating layer (not shown) for the electrodes 24*a* to 24*h*.

(j) A PSG layer 36 of a weight ratio of 8% is entirely deposited, and patterning is performed by plasma etching.

(k) The PSG layer 36 is performed by plasma etching so that the holes 27*b* (not shown) and 28*b* are formed. The end points are detected with 30% overetching.

(l) A polycrystalline-silicon layer 37*a* (not shown) and 37*b* are deposited, forming the guide pins 27, 28 by plasma etching as shown in FIG. 1, and annealing is performed to remove the residual stress.

(m) The PSG layers (or oxide films) 33, 33*a* and 36 are dissolved with a buffered hydrofluoric acid to form a movable member into which the polycrystalline-silicon layer 34 and the oxide film 35 are integrated, thereby forming the slider 25 as shown in FIG. 1.

Figure 7N:
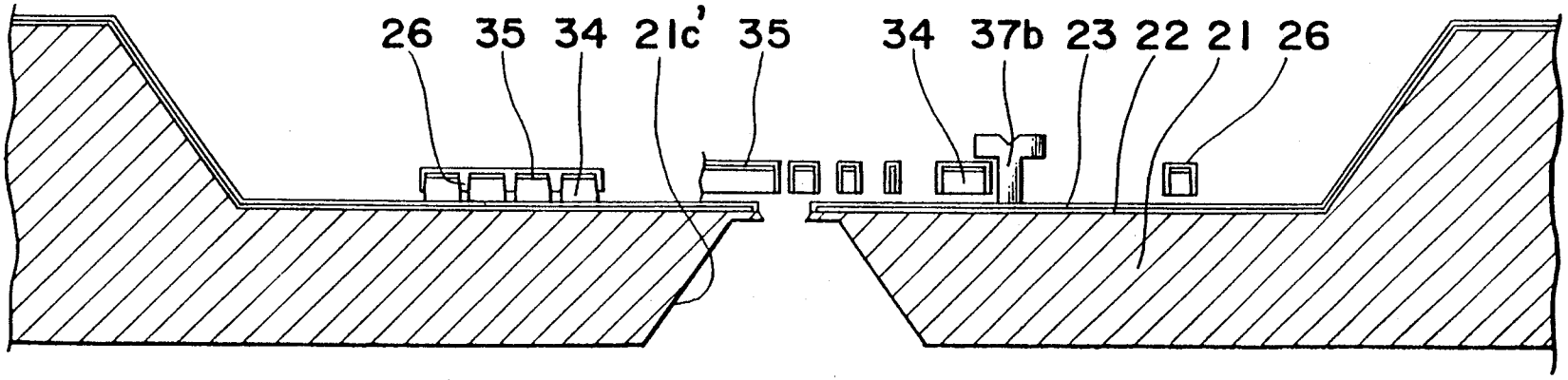

(n) The substrate 21 is anisotropically etched from its rear side as shown in FIG. 7*n* to form the concave portion 21*c*', until it is bored through up to the concave portion 21*a*', first formed. This allows the ink jet port 21*a* and the ink chamber 21*b*, as shown in FIG. 2, to be formed.

Through the above processes, the ink recording apparatus of the first embodiment of the present invention can be manufactured. As seen here, the component structures are integrally manufactured using semiconductor device manufacturing processes, thereby allowing the structures to be integrated very simply and furthermore rendering them high in precision as well as steady in performance. Besides, it is possible to increase the quantity of ink jet head and to enhance the density by assembling the units crosswise. Accordingly, the ink recording apparatus can be steadily mass-produced yet have remarkably good area gradation recording by changing the ink droplet size, low cost, light weight and compactness, and further high speed and high density recording.

Figure 8:
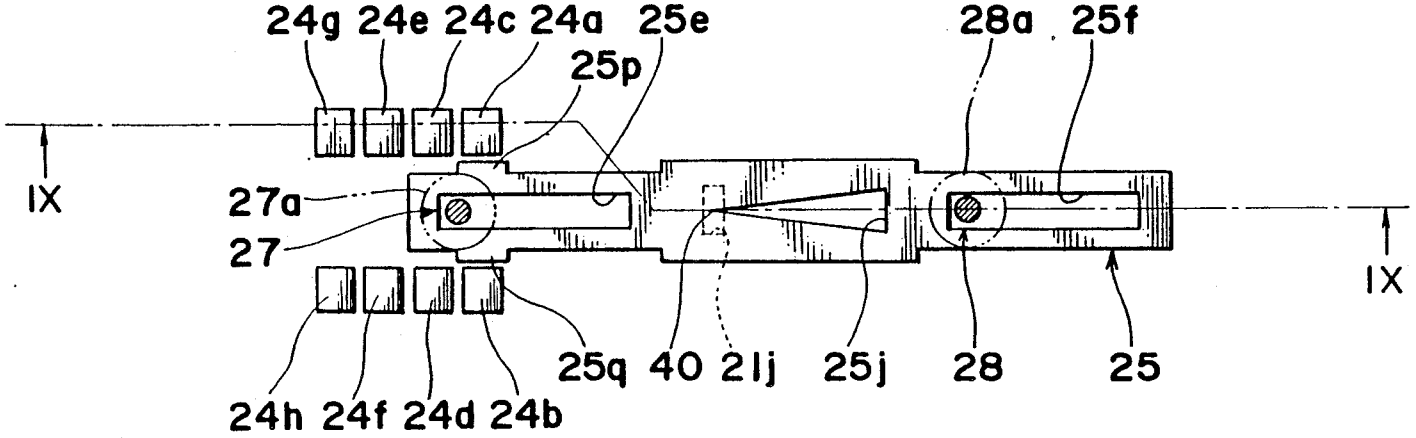
FIG. 8 is a plan view showing the construction of a second embodiment of the present invention.
Figure 9:
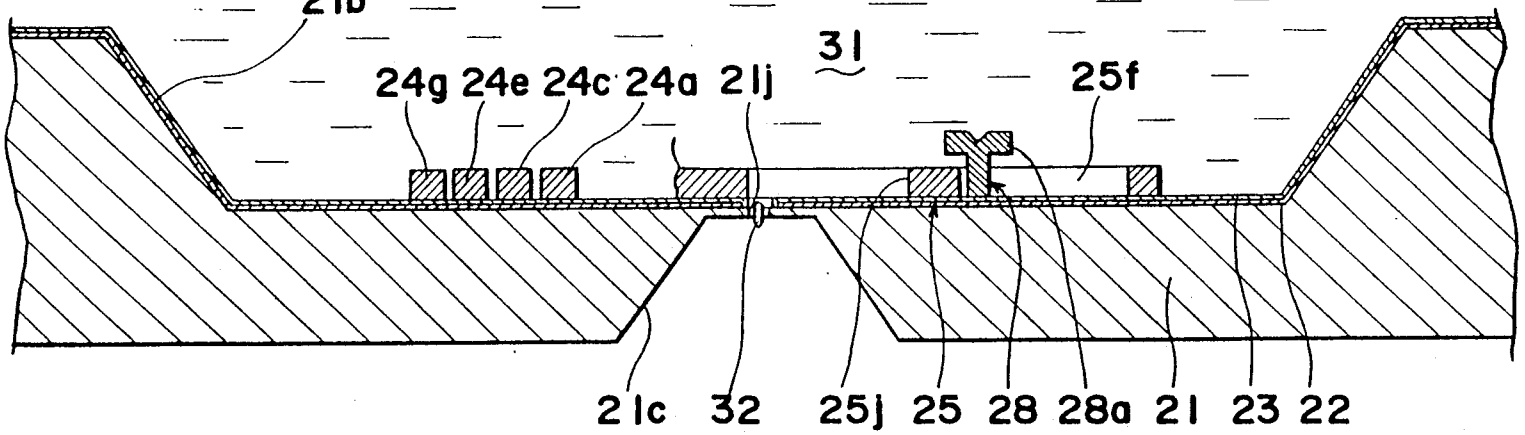
FIG. 9 is a sectional view taken along line IX—IX of FIG. 8.

Referring to FIGS. 8 and 9, the ink recording apparatus of the second embodiment of the present invention will be described below with respect to different points from the above mentioned first embodiment. The substrate 21 is provided with a wide ink jet port 21*j*, and the slider 25 is provided with a triangular ink passing hole 25*j*. As shown in FIG. 8, the ink jet port 21*j* is wider than the ink passing hole 25*j*, and these two apertures cooperate to form a trapezoidal window 40.

Now the ink recording apparatus of the second embodiment arranged as stated above will be explained with respect to its operation. FIGS. 8 and 9 show a state the same as FIGS. 1 to 3, in which the control circuit 61 judges the apparatus to be in recording operation according to an input signal delivered from the apparatus main body via the input terminal 62, turning on the switch 63 and activating the switches 64, 65, with the result that a voltage of several times 10 V or so is applied to the one pair of the electrodes 24*a* and 24*b*. In this state, the slider 25 is stably positioned as shown in the figures with its ends 25*p*and 25*q* sucked up by virtue of electrostatic attracting force acting between the ends and the surfaces of the electrodes 24*a* and 24*b*, where the ink passing hole 25*j* of the slider 25 is aligned with the ink jet port 21*j* provided in the substrate 21 such that the trapezoidal window 40 is formed as shown in FIG. 8. Then, due to the pressure within the ink chamber 21*b*, the ink 31 charged in the chamber 21*b* passes through the window 40, and thus the ink droplets 32*j* of which size are specified by the window 40 are jetted out.

At this point of the state of the apparatus, setting recording paper at the outside of the substrate 21 allows the ink droplets 32*j* to record dots. Then, the substrate 21 protects the slider 25 from being touched by operator's hands or fingers or other foreign matters from outside, thereby preventing the internal structure including the slider 25 from being damaged with the result of high reliability thereof. Moreover, despite the pressure applied on the slider 25 by the ink 31 within the ink chamber 21*b*, the slider 25 is not distorted by the pressure and the ink does not leak out, because the slider 25 is always supported by the substrate 21 on the nitride film 23 which is formed as an insulating and lubricating layer.

Figure 10:
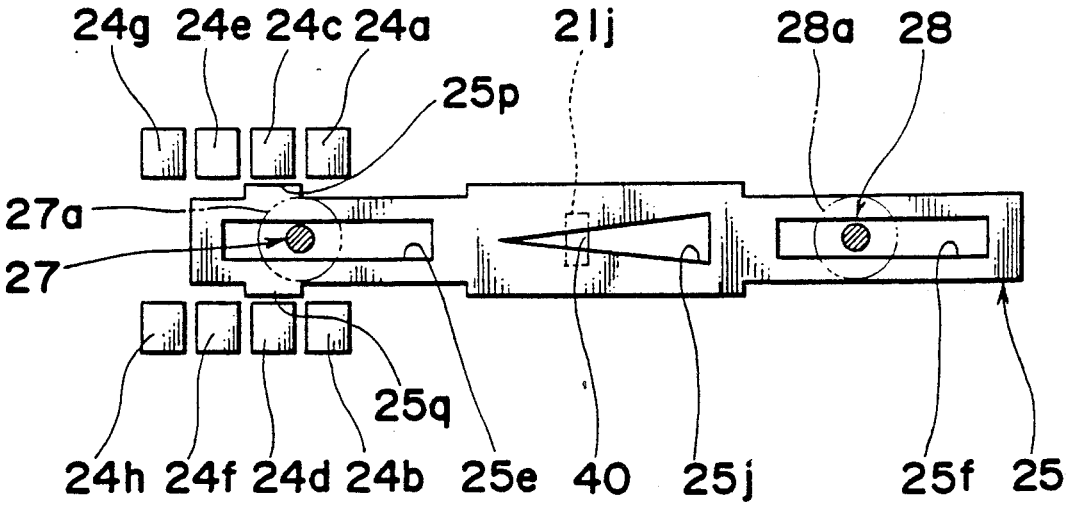
FIG. 10 is a view illustrating the operation of the ink recording apparatus of FIG. 8.

Next, with reference to FIG. 10, the ink recording apparatus of the second embodiment will be described in its states in which the slider 25 has moved away from the position shown in FIG. 8 and 9. In this case, the control circuit 61 judges that the recording condition in respect to the size of ink droplets should be jetted has been changed according to an input signal delivered from the apparatus main body via the input terminal 62, changing the condition of the switches 64, 65, with a result that a voltage is applied to another pair of the electrodes 24*c* and 24*d*. In this case, as shown in FIG. 10, the slider 25 is stably positioned at rest having moved from the position shown in FIG. 8 with its ends 25*p* and 25*q* sucked up by virtue of electrostatic attracting force acting between the ends and the surfaces of the electrodes 24*c* and 24*d*, where the overlapped portion of the ink jet port 21*j* with the ink passing hole 25*j* is wider than that of the previous state as shown in FIG. 8 so that the aperture area of the trapezoidal window 40 is enlarged. That is, in this state as shown in FIG. 10, the ink droplets jetted through the window 40 are larger than those of the previous state as shown in FIG. 8 and 9. Therefore, the apparatus of the second embodiment takes a constant time to record a dot on a sheet of recording paper despite the dot size.

When a voltage is applied to the other pair of electrodes 24*e* and 24*f*, or another pair of electrodes 24*g* and 24*h*, the slider moves so that the ink passing hole 25*j* overlaps with the ink jet port 21*j* at each position where the window 40 becomes larger step by step. Therefore, the ink recording apparatus of the second embodiment can jet various side ink droplets.

Further, the apparatus of the second embodiment as well as the first embodiment has finely variable gradation by means of changing the aperture area of the window 40, the pressure in the ink chamber, and the pressuring time. Accordingly, the ensures the dynamic range depending on the aperture area of window and also controlling the pressure condition, and the apparatus of the second embodiment can perform area gradation recording and its gradient is enough to make the apparatus useful.

In addition, according to the second embodiment of the invention, since the ink passing hole 25*j* has a triangular aperture, if the slider 25 is moved under the condition that the ink 31 is placed under pressure, the shape of the ink droplet can be varied while being jetted. Furthermore, by the control of time the applying voltage to each pair of electrodes 24*a* to 24*h*, the moving speed of the slider 25 can be controlled, thereby enabling the formation of an ink droplet in a desired shape with a desired ink amount. Thus, it is not only possible to perform area gradation recording, but also various other image recording techniques with optimum amount of ink ejection.

As described heretofore, according to the second embodiment of the present invention, it is possible to provide an ink recording apparatus which is substantially compact in size, light in weight, and also can perform area gradation recording and high speed recording because the area and shape of the aperture through which the ink droplets is jetted are continuously variable by moving the slider 25.

In addition, although in the foregoing first and second embodiments of the invention the slider 25 is driven by electrostatic attracting force which is generated by applying a voltage to electrodes 24*a* to 24*h*, it may be driven by some other means. Further, the explanation of the manufacturing method of the ink recording apparatus of the second embodiment is omitted because it is same as the first embodiment.

Further, the slider mechanism may be constituted in a similar manner to the structure of an aperture mechanism with a plurality of segments, such as is used in a camera. In this structure, assembly of sliders in segments defines an ink passing hole in the center thereof, and the aperture area is variable by shifting the respective position of the respective sliders. As the mechanism is well known, it, is not necessary to describe the details thereof, and the aperture area of the ink passing hole can be controlled by setting the shifting speed and/or stop positions of the sliders, and also the ink passing hole can be a polygonal shape close to that of a circle. That is, it is possible to provide an ink passing hole which is very convenient for an ink recording apparatus of ink jet type to form ink droplets.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is

1. An ink recording apparatus comprising:

an ink chamber for being filled with ink;

an ink jet port provided in said ink chamber;

a slider formed of a thin film and provided in a vicinity of said ink jet port, said slider controlling a jetted ink amount;

means for driving said slider, said slider driving means having electrodes provided in correspondence to each of a predetermined position, a power supply for applying voltage to said electrodes, and a control circuit associated with said slider, wherein said slider is driven by virtue of an electrostatic attracting force acting between a surface of said electrodes and a surface of said slider.

2. An ink recording apparatus as claimed in wherein said slider is provided with a plurality of ink passing holes which have respectively different sizes, wherein said ink amount is controlled by shifting said slider so that one of said ink passing holes is aligned with said ink jet port.

3. An ink recording apparatus as claimed in claim 1, wherein said slider is provided with an ink passing hole which cooperates with said ink jet port to define an aperture, both said slider ink passing hole and said ink jet port overlapping each other, whereby said ink amount is controlled by moving said slider so that an area of said aperture is varied.

* * * * *